US009911530B2

(12) United States Patent
Yang et al.

(10) Patent No.: US 9,911,530 B2
(45) Date of Patent: Mar. 6, 2018

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Ju Hwan Yang, Suwon-si (KR); Seok Il Hong, Suwon-si (KR); Doo Young Kim, Suwon-si (KR); Jae Yeol Choi, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/080,035

(22) Filed: Mar. 24, 2016

(65) Prior Publication Data

US 2017/0032882 A1 Feb. 2, 2017

(30) Foreign Application Priority Data

Jul. 31, 2015 (KR) ..... 10-2015-0109049

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 17/00*** | (2006.01) |
| ***H01F 19/04*** | (2006.01) |

(52) U.S. Cl.

CPC ..... *H01F 27/2804* (2013.01); *H01F 17/0013* (2013.01); *H01F 19/04* (2013.01); *H01F 41/042* (2013.01); *H01F 2017/0093* (2013.01); *H01F 2027/2809* (2013.01)

(58) Field of Classification Search

CPC ..... H01F 3/08; H01F 27/2804; H01F 27/255; H01F 2027/2809; H01F 17/0013; H01F 19/04; H01F 2017/0093; H01F 2017/002; H01F 2017/0073

USPC ..... 336/223, 200, 233

See application file for complete search history.

(56) References Cited

U.S. PATENT DOCUMENTS

| | | | | |
|---|---|---|---|---|
| 5,583,474 | A * | 12/1996 | Mizoguchi | H01F 17/0006 336/200 |
| 7,397,334 | B2 | 7/2008 | Yoshida et al. | |
| 8,410,575 | B2 * | 4/2013 | Kerber | H01L 23/5225 257/531 |
| 2003/0189788 | A1 * | 10/2003 | Kamijima | B82Y 10/00 360/123.25 |

(Continued)

FOREIGN PATENT DOCUMENTS

| | | | |
|---|---|---|---|
| JP | 2008-251590 | A | 10/2008 |
| KR | 10-2014-0137306 | A | 12/2014 |
| KR | 10-2015-0019588 | A | 2/2015 |

*Primary Examiner* — Mangtin Lian

(74) *Attorney, Agent, or Firm* — McDermott Will & Emery LLP

(57) ABSTRACT

A coil component includes: a coil part including a first coil layer and a second coil layer disposed above the first coil layer, wherein the first coil layer includes a first insulating layer having a first opening pattern and a first conductive layer disposed in the first opening pattern, and the second coil layer includes a second insulating layer having a second opening pattern, a seed layer covering inner side surfaces and a lower surface of the second opening pattern, and a second conductive layer disposed in the second opening pattern.

16 Claims, 13 Drawing Sheets

(56) References Cited

U.S. PATENT DOCUMENTS

| | | | | |
|---|---|---|---|---|
| 2013/0249664 | A1* | 9/2013 | Tonoyama | H01F 41/04<br>336/200 |
| 2015/0048918 | A1 | 2/2015 | Park et al. | |

* cited by examiner

I - I'

II - II'

COIL COMPONENT AND METHOD OF MANUFACTURING THE SAME

CROSS-REFERENCE TO RELATED APPLICATION

This application claims the benefit of priority to Korean Patent Application No. 10-2015-0109049, filed on Jul. 31, 2015 with the Korean Intellectual Property Office, the entirety of which is incorporated herein by reference.

TECHNICAL FIELD

The present disclosure relates to a coil component and a method of manufacturing the same.

BACKGROUND

Data is commonly transmitted and received within a high frequency band in electronic devices such as digital televisions (TV), mobile phones, laptop computers, and the like. Two or more multifunctionalized electronic devices having a high degree of complexity may be connected to each other. In order to rapidly perform the transmission and reception of data, data should be transmitted within the GHz frequency band, rather than the MHz frequency band. In this case, a larger amount of internal signal lines are required, and it is necessary to transmit and receive a larger amount of data through internal signal lines.

At the time of transmitting data between a main device and a peripheral device using the GHz frequency band in order to allow large amounts of data to be transmitted and received as described above, delays in signals and other noise may occur, disrupting the smooth processing of the data. In order to solve this problem, an electromagnetic interference (EMI) countermeasure component has been provided adjacently to a connection portion between the main device and the peripheral device. For example, a common mode filter (CMF), or the like, has been used.

In accordance with the miniaturization and thinning of electronic devices, there is increased demand for the miniaturization and thinning of a coil component such as a common mode filter, or the like. Therefore, research has been actively conducted into the development of a thin film type coil component, rather than a winding type coil component, which is more difficult to thin and miniaturize. In order to form the coil patterns of the thin film type coil component as described above, a semi-additive process (SAP), or the like, of forming a seed layer on a board in advance, coating and developing photosensitive materials for patterns on the seed layer, disposing a copper plating material between the patterns to form coil patterns, and then removing the photosensitive materials for insulation and the seed layer by flash etching, or the like, has mainly been used in the related art.

Since the photosensitive materials for patterns and the photosensitive materials for insulation are used doubly in the process as described above, manufacturing costs may be relatively high, while productivity may be low. In addition, in a case in which a lower layer is not perfectly flat due to the flash etching, or the like, at the time of forming the coil patterns as a multilayer structure, a margin of a line may be reduced. In addition, a coil loss rate may be relatively high.

SUMMARY

An aspect of the present disclosure provides a coil component of which manufacturing productivity is excellent, a coil loss rate is low, and resolution of a fine line width may be improved, and a method of manufacturing the same.

According to an aspect of the present disclosure, a coil component includes: a coil part including a first coil layer and a second coil layer disposed above the first coil layer, wherein the first coil layer includes a first insulating layer having a first opening pattern and a first conductive layer disposed in the first opening pattern without a seed layer, and the second coil layer includes a second insulating layer having a second opening pattern, a seed layer covering inner side surfaces and a lower surface of the second opening pattern, and a second conductive layer disposed on the seed layer in the second opening pattern.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
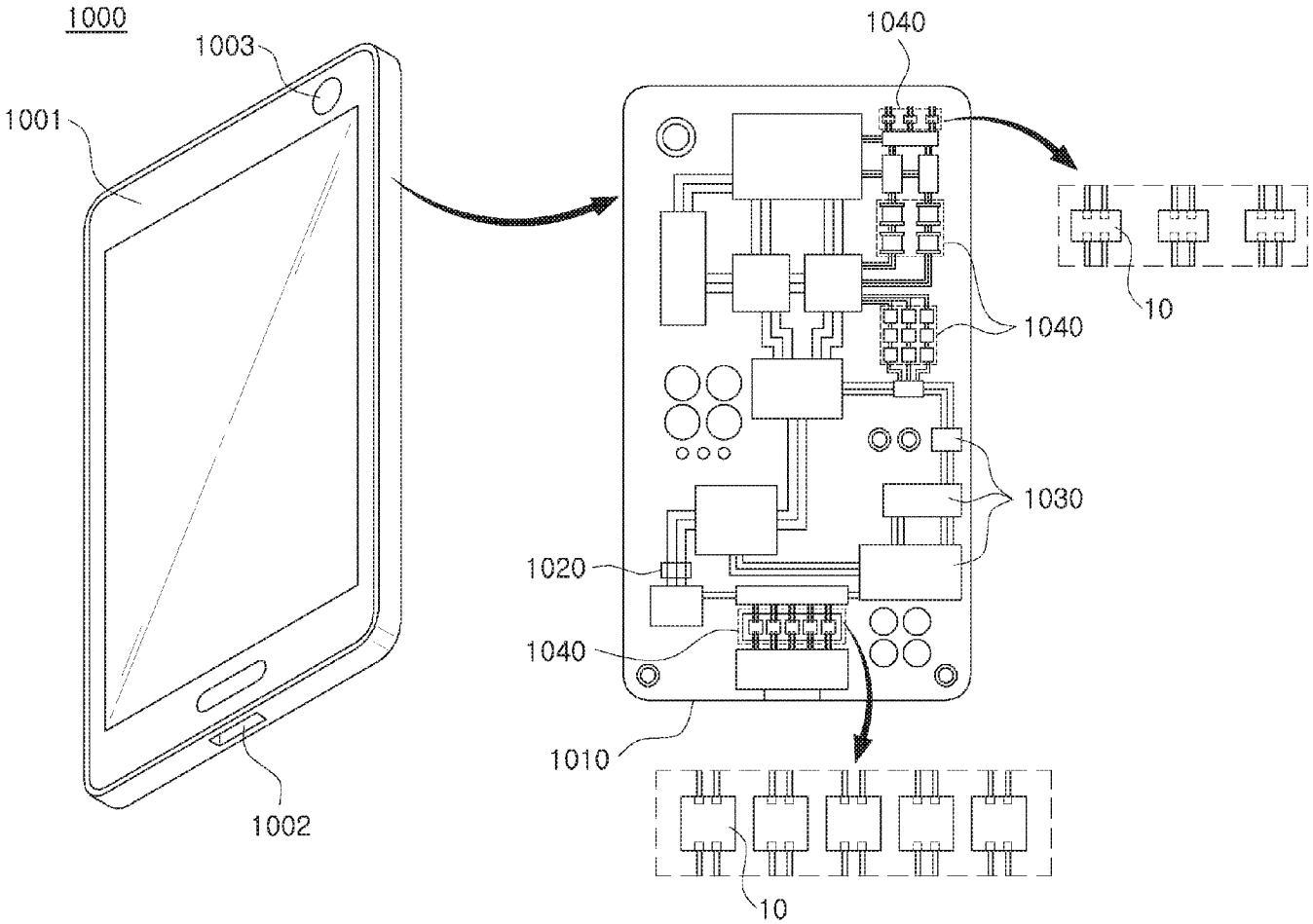
FIG. 1 is a view schematically illustrating a coil component used in an electronic device according to an exemplary embodiment.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Hereinafter, exemplary embodiments of the present invention will be described in detail with reference to the accompanying drawings. In the accompanying drawings, shapes and dimensions of components may be exaggerated for clarity.

Electronic Device

FIG. 1 is a view schematically illustrating a coil component used in an electronic device according to an exemplary embodiment.

Referring to FIG. 1, an electronic device 1000 may be a mobile phone including a case 1001, a universal serial bus (USB) input unit 1002, a camera module 1003, and the like. The mobile phone 1000 may include a main board 1010, various electronic components 1030 and 1040 mounted on or embedded in the main board 1010 and connected to each other through circuit patterns 1020, and the like, which are disposed in the mobile phone 1000. Here, coil components 10 according to the present disclosure, for example, common mode filters, may be mounted as some of the electronic components 1030 and 1040 in regions corresponding to the USB input unit 1002, the camera module 1003, and the like, of the electronic device 100. However, the coil component 10 according to the present disclosure is not limited to the common mode filter, but may also be another coil component.

The coil component according to the present disclosure may be similarly or differently used in another electronic device as well as in the mobile phone illustrated in FIG. 1. For example, the coil component according to the present disclosure may be used for various purposes in a personal digital assistant, a digital video camera, a digital still camera, a network system, a computer, a monitor, a television, a video game console, a smartwatch, or various electronic devices well-known in those skilled in the art.

Coil Component

Hereinafter, a coil component according to the present disclosure, for convenience, a common mode filter will be described. However, the coil component according to the present disclosure is not limited thereto. Contents according to the present disclosure may also be applied to coil components having various purposes.

Figure 2:
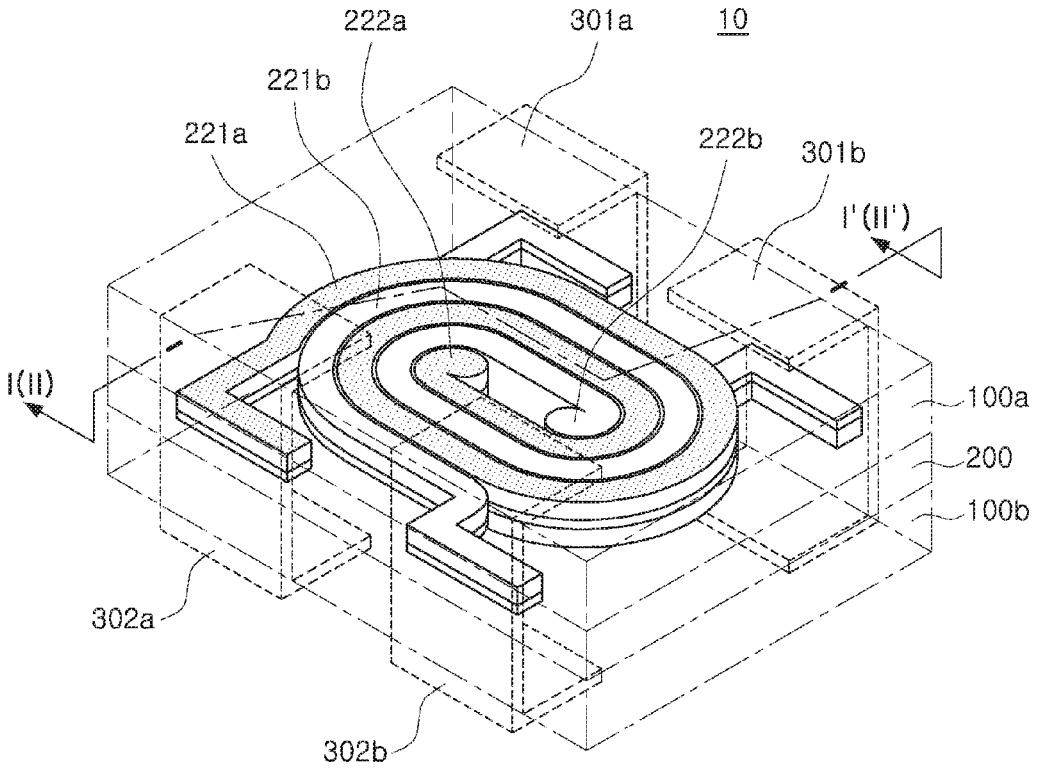
FIG. 2 is a schematic perspective view illustrating a coil component according to an exemplary embodiment.

FIG. 2 is a schematic perspective view illustrating a coil component according to an exemplary embodiment.

Referring to FIG. 2, a coil component 10 according to an exemplary embodiment may include a coil part 200, cover parts 100*a* and 100*b* disposed on and below the coil part 200, and external electrodes 301*a*, 301*b*, 302*a*, and 302*b* of which at least portions are disposed on the cover parts 100*a* and 100*b*. Here, a term 'on' refers to a direction away from a board 500 in a manufacturing process to be described below, and a term 'below' refers to a direction toward the board 500 in a manufacturing process to be described below. Here, a term 'positioned on or below' includes a case in which a target component is positioned in a corresponding direction, but does not directly contact a reference component as well as a case in which the target component directly contacts the reference component.

The cover parts 100*a* and 100*b* may serve as paths of magnetic flux generated in the coil part 200. To this end, the cover parts 100*a* and 100*b* may contain magnetic materials. In addition, the cover parts 100*a* and 100*b* may serve to support the external electrodes 301*a*, 301*b*, 302*a*, and 302*b* and/or serve to mechanically and electrically protect the coil part 200. Further, the cover parts 100*a* and 100*b* may also provide mounting surfaces when the coil component 10 is mounted in various electronic devices. The cover parts 100*a* and 100*b* may be sheet type cover parts. In this case, since the cover parts 100*a* and 100*b* may be simply formed by compressing and stacking sheet type magnetic materials, process productivity may be improved. The cover parts 100*a* and 100*b* may include a first cover part 100*a* disposed on the coil part 200 and a second cover part 100*b* disposed below the coil part 200.

The magnetic materials contained in the cover parts 100*a* and 100*b* are not particularly limited as long as they have magnetic properties. For example, the magnetic materials contained in the cover parts 100*a* and 100*b* may include one or more selected from the group consisting of metal magnetic powder particles and ferrite, but are not necessarily limited thereto. The metal magnetic powder may be a crystalline or amorphous metal including one or more selected from the group consisting of, for example, Fe, Si, Cr, Al, and Ni, but is not limited thereto. The ferrite may be, for example, Fe—Ni—Zn based ferrite, Fe—Ni—Zn—Cu based ferrite, Mn—Zn based ferrite, Ni—Zn based ferrite, Zn—Cu based ferrite, Ni—Zn—Cu based ferrite, Mn—Mg based ferrite, Ba based ferrite, Li based ferrite, or the like, but is not limited thereto.

The coil part 200 may perform various functions in the electronic device through a property appearing in a coil of the coil component 10. In the coil component 10 according to an exemplary embodiment, the coil part 200, a thin film type coil part, or the like, may be distinguished from a winding type coil part having a structure in which a conducting wire is simply wound around a magnetic core. A detailed content for the coil part 200 will be described below.

The external electrodes 301*a*, 301*b*, 302*a*, and 302*b* may serve to connect the coil component 10 to the electronic device. In the coil component 10 according to an exemplary embodiment, at least portions of the external electrodes 301*a*, 301*b*, 302*a*, and 302*b* may be disposed on the first and second cover parts 100*a* and 100*b*, respectively. Since at least portions of the external electrodes 300 are disposed on both of the first and second cover parts 100*a* and 100*b*, as described above, both of the first and second cover parts 100*a* and 100*b* may provide the mounting surfaces. Therefore, since the coil component 10 may not be affected by a direction when it is mounted in the electronic device, a process may be further simplified. The external electrodes 301*a*, 301*b*, 302*a*, and 302*b* may include first to fourth external electrodes 301*a*, 301*b*, 302*a*, and 302*b*, which may be connected to first to fourth coil patterns 211*a*, 211*b*, 221*a*, and 221*b* of a coil part 200 to be described below, respectively. In addition, the external electrodes 301*a*, 301*b*, 302*a*, and 302*b* may have a '⊏' shape. However, the external electrodes 301*a*, 301*b*, 302*a*, and 302*b* are not limited to having the '⊏' shape, but may have various shapes.

A material of the external electrode 300 is not particularly limited as long as it is a metal that may provide electrical conductivity. For example, the external electrode 300 may contain one or more selected from the group consisting of gold, silver, platinum, copper, nickel, palladium, and alloys thereof, but is not limited thereto. Gold, silver, platinum and palladium are expensive but stable, while copper and nickel are less expensive but may be oxidized while being sintered, such that electrical conductivity may be reduced.

Figure 3:
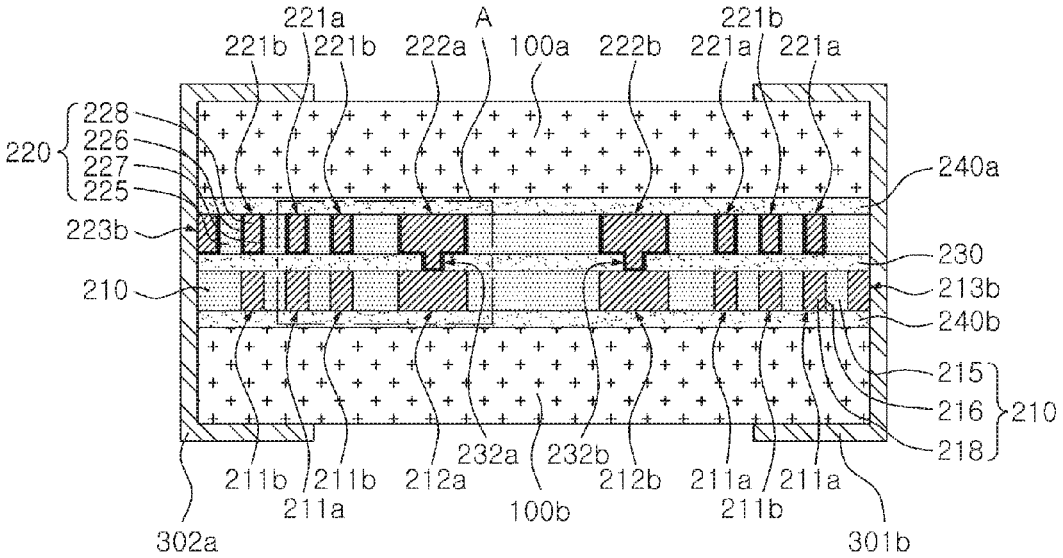
FIG. 3 is a schematic cross-sectional view of the coil component taken along line I-I' of FIG. 2.

FIG. 3 is a schematic cross-sectional view of the coil component taken along line I-I' of FIG. 2.

Referring to FIG. 3, the coil part 200 of the coil component 10 according to an exemplary embodiment may include coil layers 210 and 220, an interlayer dielectric layer 230 disposed between the coil layers 210 and 220, and insulating cover layers 240*a* and 240*b* disposed on and below the coil layers 210 and 220.

Each of the coil layers 210 and 220 may have a double coil in which two coil patterns 211*a* and 211*b*, and 221*a* and 221*b* are formed on substantially the same plane. Alternatively, each of the coil layers 210 and 220 may also be implemented as a single coil having a multilayer form. In a case in which each of the coil layers 210 and 220 is a double coil, a manufacturing process may be simple, such that a manufacturing cost may be reduced.

The coil layers 210 and 220 may have a first coil layer 210 and a second coil layer 220. The first coil layer 210 may include first and second coil patterns 211*a* and 211*b* formed on substantially the same plane. The second coil layer 220 may include third and fourth coil patterns 221*a* and 221*b* formed on substantially the same plane. However, although only two coil layers 210 and 220 have been illustrated in FIG. 3, the number of coil layers may be two or more. For example, a third coil layer and a fourth coil layer may further be stacked. In this case, added coil layers, for example, the third and fourth coil layers, and the like, may be stacked in a form of the second coil layer 200.

The first coil pattern 211*a* may be electrically connected to the third coil pattern 221*a* through a first via pattern 232*a*. Therefore, a single first coil electrode configured of a series-connected circuit of two coils 211*a* and 221*a* may be configured. The second coil pattern 211*b* may be electrically connected to the fourth coil pattern 221*b* through a second via pattern 232*b*. Therefore, a single second coil electrode configured of a series-connected circuit of two coils 211*b* and 221*b* may be configured. In this case, when currents flow in the same direction between the first and second coil electrodes, magnetic fluxes may be reinforced with each other, such that a common mode impedance is increased to suppress common mode noise, and when currents flow in opposite directions between the first and second coil electrodes, magnetic fluxes may be offset against with each other, such that a differential mode impedance is reduced, whereby the coil component may be operated as a common mode filter passing a desired transmission signal therethrough.

The first coil layer 210 may include first and second via connecting patterns 212*a* and 212*b* directly connected to the via patterns 232*a* and 232*b*. Here, the first and second via connecting patterns 212*a* and 212*b* mean distal end portions of the first and second coil patterns 211*a* and 211*b* vertically connected directly to the via patterns 232*a* and 232*b*, respectively. The second coil layer 220 may include third and fourth via connecting patterns 222*a* and 222*b* directly connected to the via patterns 232*a* and 232*b*. Here, the third and fourth via connecting patterns 222*a* and 222*b* mean distal end portions of the third and fourth coil patterns 221*a* and 221*b* vertically connected directly to the via patterns 232*a* and 232*b*, respectively.

The first coil layer 210 may include first and second lead terminals 213*a* (not shown) and 213*b* connected to the external electrodes 301*a* and 301*b*. Here, the first and second lead terminals 213*a* and 213*b* may be connected to the first and second external electrodes 301*a* and 301*b*, respectively. The second coil layer 220 may include third and fourth lead terminals 223*a* (not shown) and 223*b* connected to the external electrodes 302*a* and 302*b*. Here, the third and fourth lead terminals 223*a* and 223*b* may be connected to the third and fourth external electrodes 302*a* and 302*b*, respectively. The coil part 200 may be electrically connected to the external electrodes 301*a*, 301*b*, 302*a*, and 302*b* through the lead terminals. However, the lead terminals 213*a* and 213*b* are not limited to having the forms illustrated in FIG. 3, and may have various forms well known in the related art.

The interlayer dielectric layer 230 may electrically insulate the coil patterns 211*a* and 211*b*, and 221*a* and 221*b* formed on different layers from each other. Here, the via patterns 232*a* and 232*b* may be formed in the interlayer dielectric layer 230, and the coil patterns 211*a* and 211*b*, and

221*a* and 221*b* formed on the different layers through the via patterns 232*a* and 232*b*. For example, the interlayer dielectric layer 230 may include the first via pattern 232*a* connecting the first coil pattern 211*a* and the third coil pattern 221*a* to each other and the second via pattern 232*b* connecting the second coil pattern 211*b* and the fourth coil pattern 221*b* to each other. A material of the interlayer dielectric layer 230 may be a resin in which a reinforcing material such as a glass fiber or an inorganic filler is impregnated, for example, prepreg, a thermosetting resin, a photo-curable resin, an Ajinomoto build-up film (ABF), or the like, but is not limited thereto. The interlayer dielectric layer 230 may be present in a form in which it is attached due to characteristics of a material thereof.

The insulating cover layers 240*a* and 240*b* may electrically insulate upper and lower portions of the coil layers 210 and 220 from the outside. The insulating cover layers 240*a* and 240*b* may include a first insulating cover layer 240*a* disposed on the second coil layer 220 and a second insulating cover layer 240*b* disposed below the first coil layer 210. A material of the insulating cover layers 240*a* and 240*b* may be a resin in which a reinforcing material such as a glass fiber or an inorganic filler is impregnated, for example, prepreg, a thermosetting resin, a photo-curable resin, an Ajinomoto build-up film (ABF), or the like, but is not limited thereto. The insulating cover layers 240*a* and 240*b* may be present in a form in which they are attached due to characteristics of a material thereof. In a case in which more coil layers are stacked on the second coil layer 220, the first insulating cover layer 240*a* may be disposed on the outermost coil layer.

Figure 4:
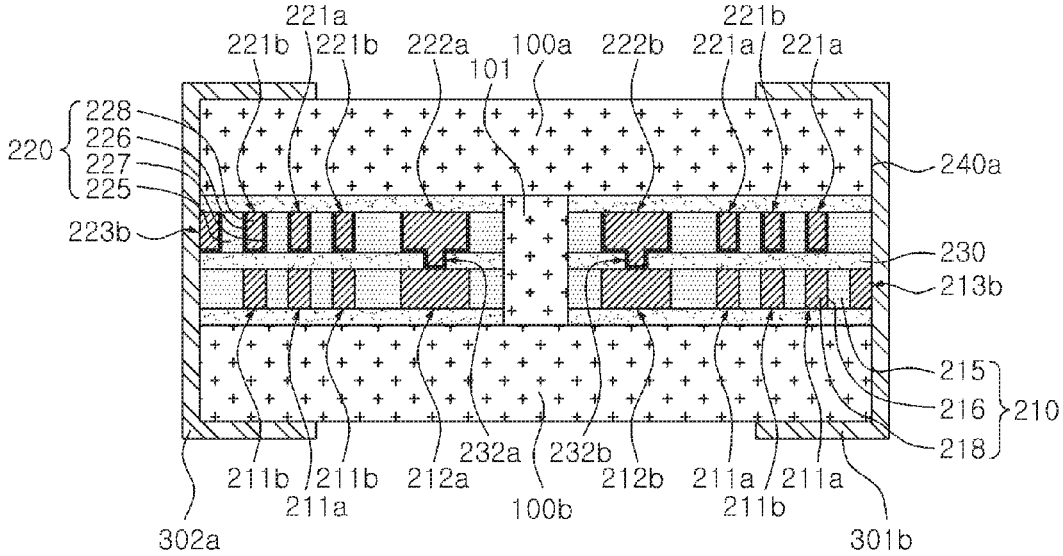
FIG. 4 is a schematic cross-sectional view of the coil component taken along line II-II' of FIG. 2.

FIG. 4 is another schematic cross-sectional view of the coil component taken along line II-II' of FIG. 2.

Referring to FIG. 4, the coil component 10 according to an exemplary embodiment may further include a magnetic core 101 penetrating through a central portion of the coil part 200. The magnetic core 101 may penetrate through all of the coil layers 210 and 220, the interlayer dielectric layer 230, and the insulating cover layers 240*a* and 240*b*. Alternatively, in some cases, the magnetic core 101 may also penetrate through only the coil layers 210 and 220 and the interlayer dielectric layer 230. When the coil component 10 further includes the magnetic core 101, inductances of the coil layers 210 and 220 may be further increased, and the coil component 10 may be provided with a higher degree of performance. The magnetic core 101 may be integrated with the cover parts 100*a* and 100*b*.

Magnetic materials contained in the magnetic core 101 are also not particularly limited as long as they have a magnetic property. For example, the magnetic materials contained in the magnetic core 101 may include one or more selected from the group consisting of metal magnetic powder particles and ferrite, but are not necessarily limited thereto. The metal magnetic powder may be a crystalline or amorphous metal including one or more selected from the group consisting of, for example, Fe, Si, Cr, Al, and Ni, but is not limited thereto. The ferrite may be, for example, Fe—Ni—Zn based ferrite, Fe—Ni—Zn—Cu based ferrite, Mn—Zn based ferrite, Ni—Zn based ferrite, Zn—Cu based ferrite, Ni—Zn—Cu based ferrite, Mn—Mg based ferrite, Ba based ferrite, Li based ferrite, or the like, but is not limited thereto.

Figure 5:
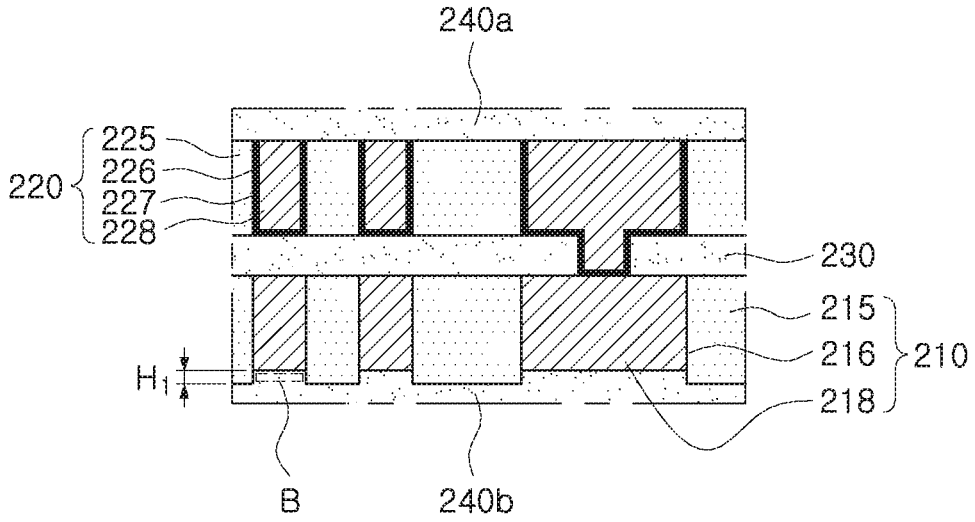
FIG. 5 is a schematic enlarged cross-sectional view of region A of the coil component of FIG. 3.

FIG. 5 is a schematic enlarged cross-sectional view of region A of the coil component of FIG. 3 according to an exemplary embodiment.

Figure 6:
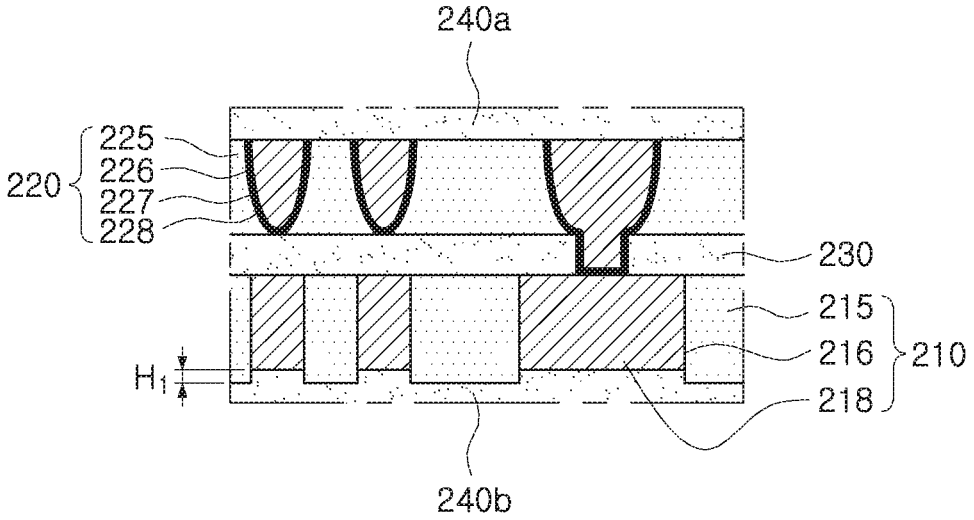
FIG. 6 is another schematic enlarged cross-sectional view of region A of the coil component of FIG. 3 according to another exemplary embodiment.

FIG. 6 is a schematic enlarged cross-sectional view of region A of the coil component of FIG. 3 according to another exemplary embodiment.

Figure 7:
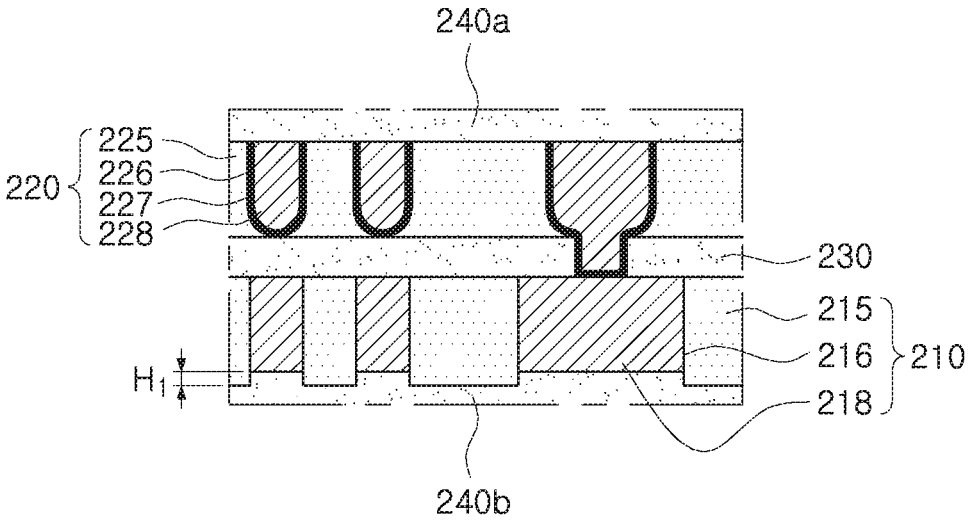
FIG. 7 is another schematic enlarged cross-sectional view of region A of the coil component of FIG. 3 according to another exemplary embodiment.

FIG. 7 is a schematic enlarged cross-sectional view of region A of the coil component of FIG. 3 according to another exemplary embodiment.

Figure 8:
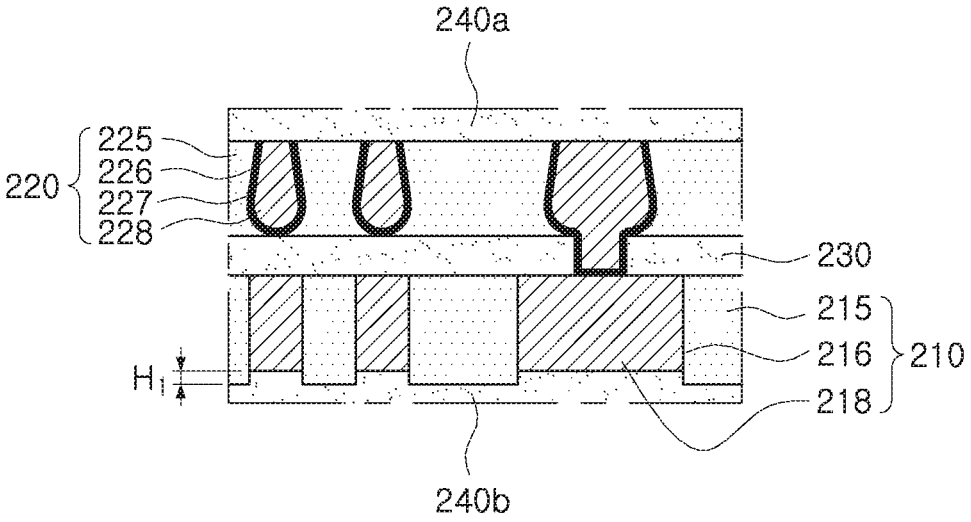
FIG. 8 is another schematic enlarged cross-sectional view of region A of the coil component of FIG. 3 according to another exemplary embodiment.

FIG. 8 is a schematic enlarged cross-sectional view of region A of the coil component of FIG. 3 according to another exemplary embodiment.

Figure 9:
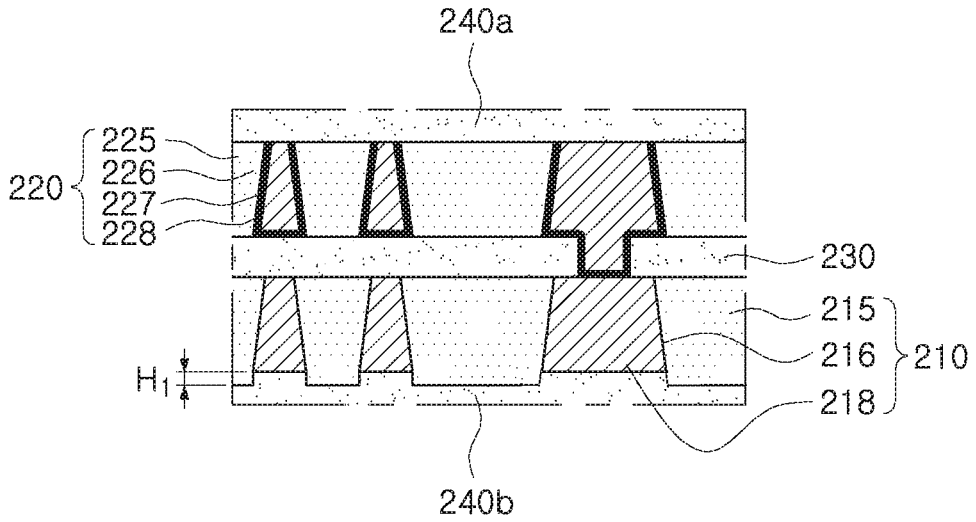
FIG. 9 is another schematic enlarged cross-sectional view of region A of the coil component of FIG. 3 according to another exemplary embodiment.

FIG. 9 is a schematic enlarged cross-sectional view of region A of the coil component of FIG. 3 according to another exemplary embodiment.

Figure 10:
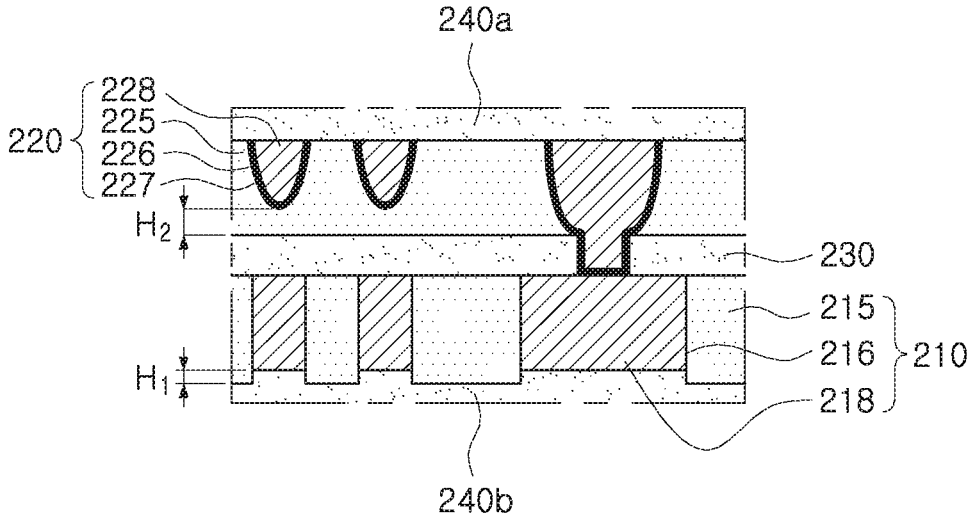
FIG. 10 is another schematic enlarged cross-sectional view of region A of the coil component of FIG. 3 according to another exemplary embodiment.

FIG. 10 is a schematic enlarged cross-sectional view of region A of the coil component of FIG. 3 according to another exemplary embodiment.

Referring to FIGS. 5 through 10, the first coil layer 210 may include a first insulating layer 215 having first opening patterns 216 and a first conductive layer 218 disposed in the first opening patterns 216. Here, the first conductive layer 218 may be disposed without a separate seed layer. The reason is that the first conductive layer 218 may be formed using a metal layer 501 disposed on a board 500 as a seed instead of the seed layer, as described in detail in a process to be described below. Therefore, a phenomenon in which an upper surface of the first conductive layer 218 is affected by flash etching may be prevented.

The first insulating layer 215 may serve to protect the coil patterns 211*a* and 211*b*, the via connecting patterns 212*a* and 212*b*, the lead terminals 213*a* and 213*b*, and the like, from impacts, moisture, high temperatures, and the like, while providing insulation properties to the coil patterns 211*a* and 211*b*, the via connecting patterns 212*a* and 212*b*, the lead terminals 213*a* and 213*b*, and the like. Therefore, a photosensitive resin, or the like, well known in the related art and easily processed may be appropriately selected as a material of the first insulating layer 215 in consideration of insulation properties, heat resistance, moisture resistance, and the like. For example, the first insulating layer 215 may be formed of the known positive or negative type of dry film, but is not limited thereto.

The first insulating layer 215 may also contain ferrite having high magnetic permeability. The ferrite may have a powder form. For example, a Fe—Ni—Zn oxide based material, a Fe—Ni—Zn—Cu oxide based material, or the like, a soft magnetic material, may be used. In addition, a metal based material such as Fe, Ni, Fe—Ni (Permalloy), or the like, or a mixture thereof may be used. The ferrite powder particles may be dispersed and contained between patterns such as the coil patterns 211*a* and 211*b*, the via connecting patterns 212*a* and 212*b*, the lead terminals 213*a* and 213*b*, and the like. Therefore, the first insulating layer 215 may have high magnetic permeability to thereby be operated as a path of a magnetic flux loop. As a result, a flow of the magnetic flux loop generated in the coil patterns 211*a* and 211*b*, the via connecting patterns 212*a* and 212*b*, the lead terminals 213*a* and 213*b*, and the like, may become smoother, thereby improving impedance characteristics.

The first opening patterns 216 may correspond to basic structures of the coil patterns 211*a* and 211*b*, the via connecting patterns 212*a* and 212*b*, the lead terminals 213*a* and 213*b*, and the like. Here, a planar shape of the first opening pattern may be a spiral shape. As described above, since the planar shape is the spiral shape, a coil pattern may be formed. The first opening patterns 216 may be formed by directly patterning the first insulating layer 215. Therefore, a separate photosensitive material for patterns is not required, unlike in the related art, and the number of processes may also be reduced. In addition, in a case in which the coil patterns are formed by a semi-additive process, or the like, as in the related art, the number of required processes is relatively large, and upper portions of plating patterns are affected in a flash etching process for removing a seed layer after removing a photo-resist, such that some of the plating patterns are irregularly removed, whereby there is a limitation in implementing patterns having a desired shape. On the other hand, in a case in which the plating patterns are formed after the first opening patterns 216 are formed by patterning the first insulating layer 215 in a thickness direction using exposure and development as in an exemplary embodiment, the problem as described above does not occur. In addition, since the coil patterns are formed by directly patterning the insulating layer, the coil patterns may have an aspect ratio higher than that of the coil patterns according to the related art.

A material of the first conductive layer 218 is not particularly limited as long as it is a metal that is a main material forming the coil patterns 211*a* and 211*b*, the via connecting patterns 212*a* and 212*b*, the lead terminals 213*a* and 213*b*, and the like, and may give electrical conductivity. The first conductive layer 218 may contain one or more selected from the group consisting of, for example, gold, silver, platinum, copper, nickel, palladium, and alloys thereof.

A lower surface of the first conductive layer 218 and a lower surface of the first insulating layer 215 may have steps $H_1$ therebetween. As described in detail in a process to be described below, the metal layer 501 disposed on the board 500 may be used as the seed instead of the seed layer when the first conductive layer 218 is formed. In this case, since the lower surface of the first conductive layer 218 may also be affected in a process of removing the metal layer 501 by etching, or the like, the steps $H_1$ may be generated between the lower surface of the first conductive layer 218 and the lower surface of the first insulating layer 215. However, since only the lower surface of the first conductive layer 218 is affected, a desired pattern shape may be maintained on an upper surface of the first conductive layer 218 as it is. Meanwhile, step regions B in the first opening patterns 216 may be filled with an insulating material. For example, the step regions B may be filled with an insulating material of the second insulating cover layer 240*b* in a process of forming the second insulating cover layer 240*b*. Since the steps $H_1$ and the step regions B are formed as intaglio below the first opening patterns 216, coil patterns having excellent resolution may be formed.

Referring to FIGS. 5 through 10, the second coil layer 220 may include a second insulating layer 225 having second opening patterns 226, a seed layer 227 covering inner side surfaces and lower surfaces of the second opening patterns 226, and a second conductive layer 228 disposed on the seed layer 227 in the second opening patterns 226. The seed layer 227 may also be disposed on the side surfaces unlike the related art. The reason is that a process of removing the seed layer 227 is not required since the seed layer 227 is first formed over an entire surface of the second insulating layer 225 in which the second opening patterns 226 are formed, the second conductive layer 228 is formed, and planarization of the second insulating layer 225 is performed by a planarization process. Therefore, a phenomenon in which an upper surface of the second conductive layer 228 is affected by flash etching may be prevented.

The second insulating layer 225 may serve to protect the coil patterns 221*a* and 221*b*, the via connecting patterns 222*a* and 222*b*, the lead terminals 223*a* and 223*b*, and the like, from impacts, moisture, high temperatures, and the like, while providing insulation properties to the coil patterns 221*a* and 221*b*, the via connecting patterns 222*a* and 222*b*, the lead terminals 223*a* and 223*b*, and the like. Therefore, a photosensitive resin, or the like, well known in the related art and easily processed may be appropriately selected as a material of the second insulating layer 225 in consideration of insulation properties, heat resistance, moisture resistance, and the like. For example, the second insulating layer 225 may be formed of the known positive or negative type dry film, but is not limited thereto.

The second insulating layer 225 may also contain ferrite having high magnetic permeability. The ferrite may have a powder form. For example, a Fe—Ni—Zn oxide based material, a Fe—Ni—Zn—Cu oxide based material, or the like, a soft magnetic material, may be used. In addition, a metal based material such as Fe, Ni, Fe—Ni (Permalloy), or the like, or a mixture thereof may be used. The ferrite powder particles may be dispersed and contained between patterns such as the coil patterns 221*a* and 221*b*, the via connecting patterns 222*a* and 222*b*, the lead terminals 223*a* and 223*b*, and the like. Therefore, the second insulating layer 225 may have high magnetic permeability to thereby be operated as a path of a magnetic flux loop. As a result, a flow of the magnetic flux loop generated in the coil patterns 221*a* and 221*b*, the via connecting patterns 222*a* and 222*b*, the lead terminals 223*a* and 223*b*, and the like, may become smoother, thereby improving impedance characteristics.

The second opening patterns 226 may correspond to basic structures of the coil patterns 221*a* and 221*b*, the via connecting patterns 222*a* and 222*b*, the lead terminals 223*a* and 223*b*, and the like. Here, a planar shape of the second opening pattern may be a spiral shape. As described above, since the planar shape is the spiral shape, a coil pattern may be formed. The second opening patterns 226 may also be formed by directly patterning the second insulating layer 225. Therefore, a separate photosensitive material for patterns is not required unlike in the related art, and the number of processes may also be reduced. In addition, since plating patterns are formed after the second opening patterns 226 are formed by patterning the second insulating layer 225 in the thickness direction using exposure and development, the problem occurring in the SAP according to the related art does not occur.

A cross-sectional shape of an end portion of the second opening pattern 226 may be a horizontal shape, as illustrated in FIG. 5, or may be a rounded shape, as illustrated in FIGS. 6 through 8. In a case in which the cross-sectional shape of the end portion of the second opening pattern 226 has the rounded shape, that is, in a case in which the cross-sectional shape of the end portion of the second opening pattern 226 is a shape in which a central portion of the end portion protrudes toward a lower surface of the second insulating layer 225, an overlapped area between coil patterns formed on different layers may be significantly reduced, regardless of a detailed shape of a cross section. Therefore, stray or parasitic capacitance generated between the coil patterns formed on the different layers may be more effectively reduced as compared with a case in which the cross-sectional shape of the end portion of the second opening pattern 226 is the horizontal shape. In detail, stray or parasitic capacitance generated between a plurality of coil patterns 211*a*, 211*b*, 221*a*, and 221*b* needs to be significantly reduced in order to improve characteristics of the coil component in a high frequency band, as described above. Here, the capacitance may be in proportion to an interlayer overlapped area between the coil patterns 211*a* and 211*b* and 221*a* and 221*b* formed on different layers and may be in inverse proportion to an interlayer distance. Therefore, in order to significantly reduce capacitance, the overlapped area needs to be reduced or the interlayer distance needs to be increased. However, the interlayer distance needs to be short in order to secure basic characteristics of the coil component. Therefore, it may be required to significantly reduce the interlayer overlapped area, which may be most effectively implemented in the case in which the cross-sectional shape of the end portion of the second opening pattern is the rounded shape.

The second opening patterns 226 may have the effect as described above also in a case in which the coil patterns formed on different layers have a reverse tapered shape in which upper surfaces thereof have a width narrower than that of lower surfaces thereof, as illustrated in FIG. 9. However, it may be more effective for the second opening pattern 226 to have the end portion having the rounded shape. In addition, as illustrated in FIG. 10, the end portion of the second opening pattern having the rounded shape may be spaced apart from the lower surface of the second insulating layer 225 by a predetermined interval $H_2$. In this case, the end portion of the second opening pattern having the rounded shape may be more effectively implemented. The second insulating layer 225 may be partially penetrated by incompletely controlling development conditions in exposure and development. Since dissolution is not generated up to a bottom surface in a case in which the development condition is weakly controlled, the end portion of the second opening pattern having the rounded shape may be more easily implemented.

The seed layer 227, provided to easily form a second conductive layer 228 to be described below, may be formed of any metal that may give electrical conductivity. The seed layer 227 may contain one or more selected from the group consisting of, for example, gold, silver, platinum, copper, nickel, palladium, and alloys thereof.

The seed layer 227 may have a multilayer structure including a buffer seed layer containing one or more selected from the group consisting of chrome, titanium, tantalum, palladium, nickel, and alloys thereof, and a plating seed layer formed on the buffer seed layer and containing one or more selected from the group consisting of gold, silver, platinum, copper, nickel, palladium, and alloys thereof. For example, the seed layer 227 may have a double-layer structure formed of titanium and copper. The buffer seed layer may serve to secure close adhesion to the second insulating layer 225, and the plating seed layer may serve as a basic plating layer for easily forming the second conductive layer 228.

A material of the second conductive layer 228 is not particularly limited as long as it is a metal that is a main material forming the coil patterns 221*a* and 221*b*, the via connecting patterns 222*a* and 222*b*, the lead terminals 223*a* and 223*b*, and the like, and may provide electrical conductivity. The second conductive layer 228 may contain one or more selected from the group consisting of, for example, gold, silver, platinum, copper, nickel, palladium, and alloys thereof.

An upper surface of the second conductive layer 228 may have a flat shape, which may be implemented by planarization to be described below. In detail, the upper surface of the second conductive layer 228 may be substantially coplanar with an upper surface of the second insulating layer 225. In addition, the upper surface of the second conductive layer 228 may be substantially coplanar with an open surface of the seed layer 227. The open surface of the seed layer 227 means a surface of the seed layer exposed to open regions of the second opening patterns 228, as illustrated in FIGS. 5 through 10. When planarization of the second conductive layer 228 is not secured, a problem in terms of the diffraction of light may occur at the time of exposing fine patterns. In addition, when more coil layers are stacked on the second conductive layer 228, a lower portion of these coil layers is not flat, such that it may be difficult to implement a fine line width. On the other hand, when the planarization of the second conductive layer 228 is secured, this problem may not occur, and resolution of the fine line width of the coil patterns 221*a* and 221*b* may be improved.

Method of Manufacturing Coil Component

Hereinafter, a method of manufacturing a coil component according to the present disclosure, for convenience, a method of manufacturing a common mode filter will be described. However, the method of manufacturing a coil component according to the present disclosure is not limited thereto. Contents according to the present disclosure may also be applied to manufacturing of coil components having various purposes.

Figure 11A:
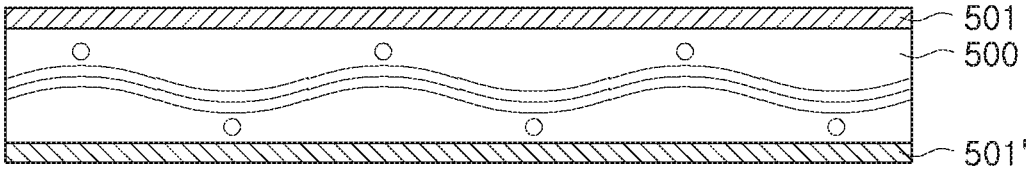
FIGS. 11A through 11O are views schematically illustrating processes of manufacturing a coil component according to an exemplary embodiment.
Figure 11B:
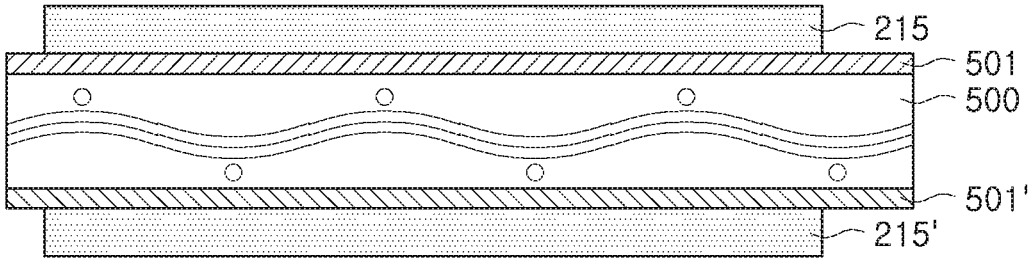
Figure 11C:
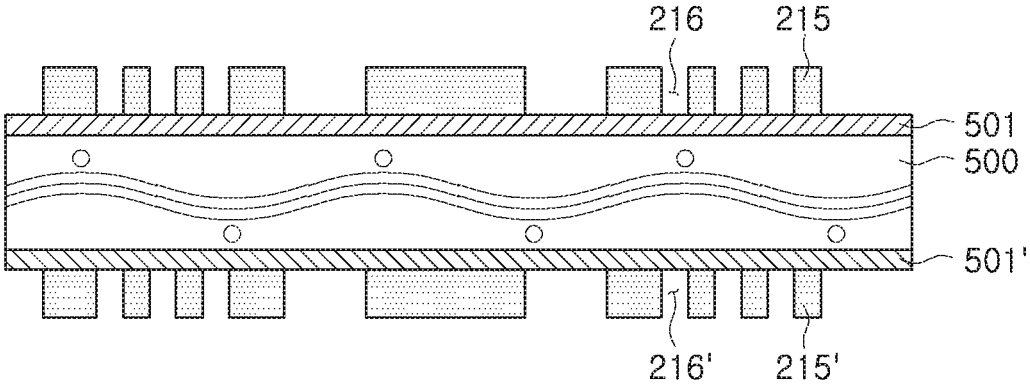
Figure 11D:
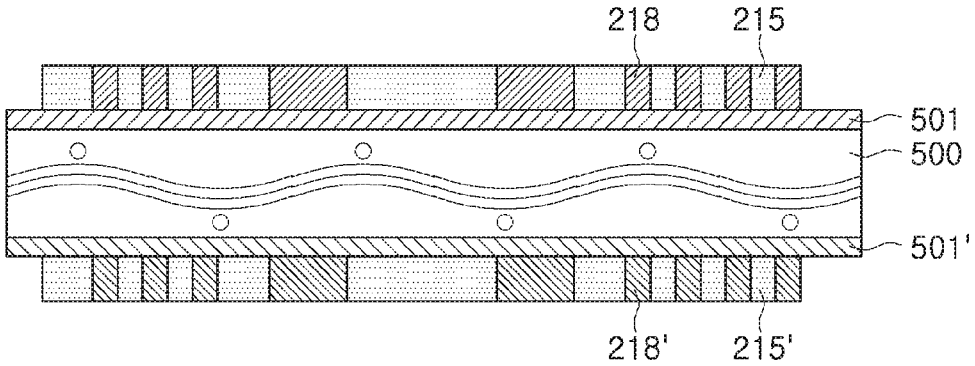
Figure 11E:
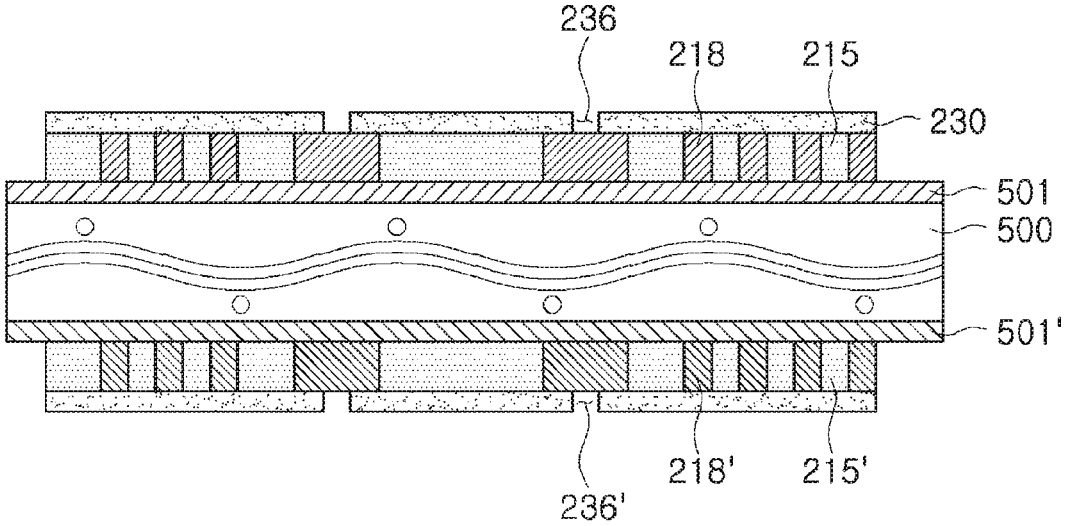
Figure 11F:
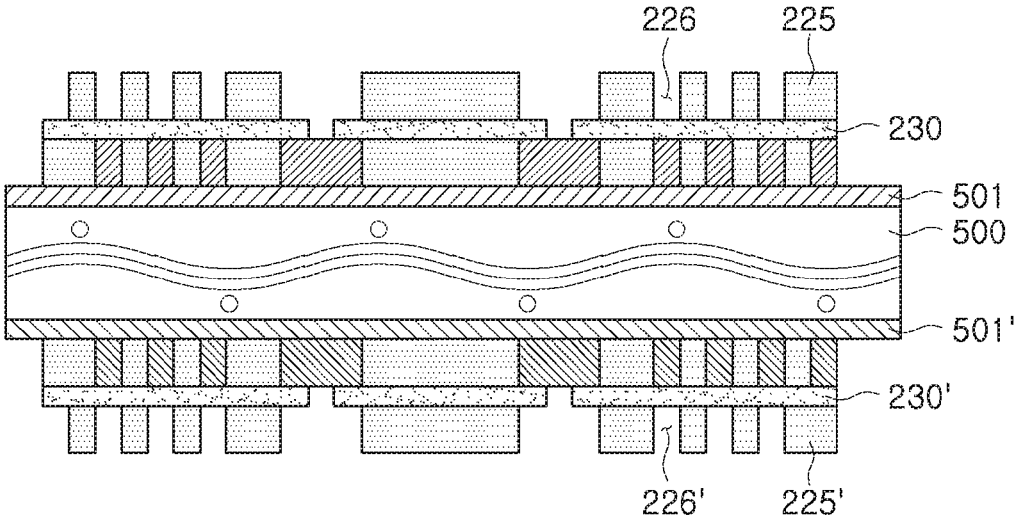
Figure 11G:
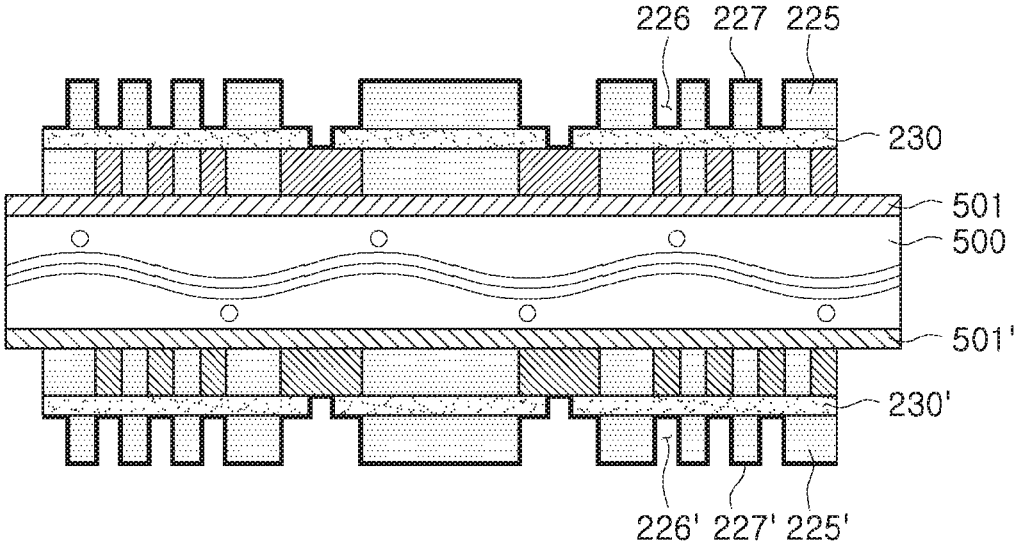
Figure 11H:
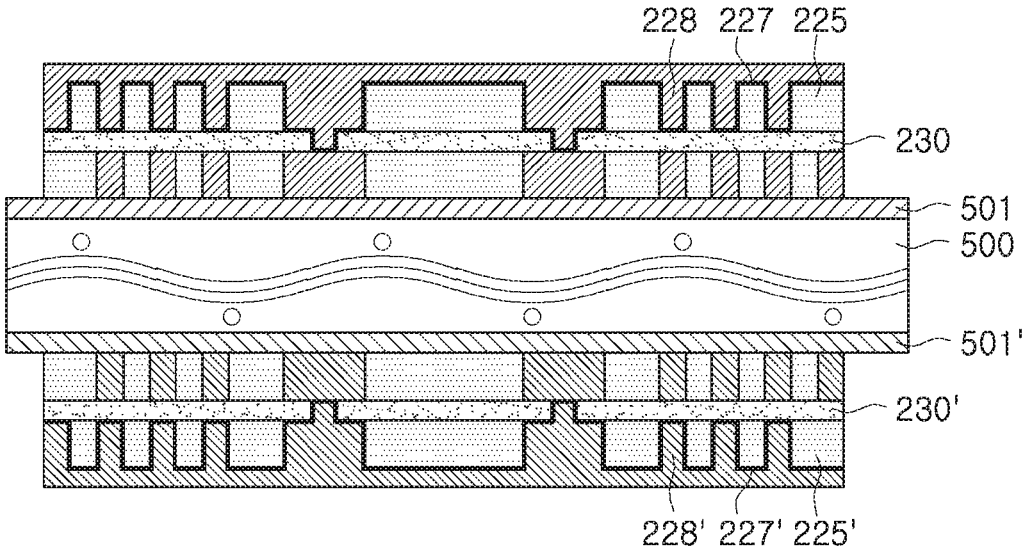
Figure 11I:
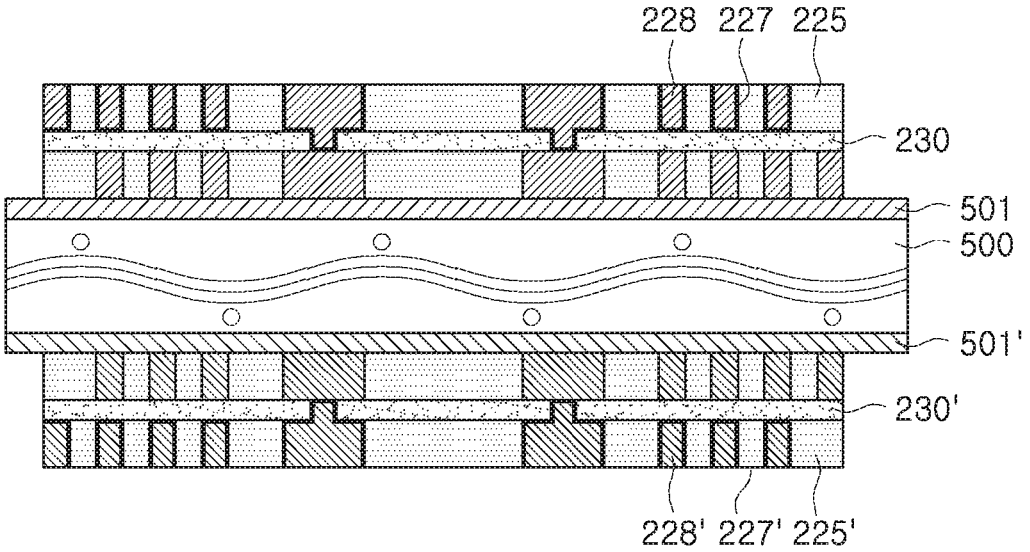
Figure 11J:
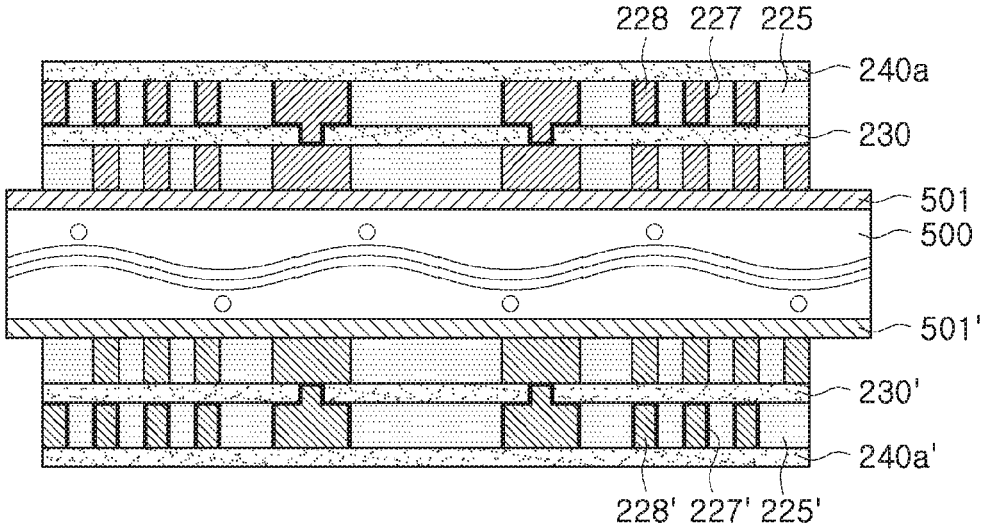
Figure 11K:
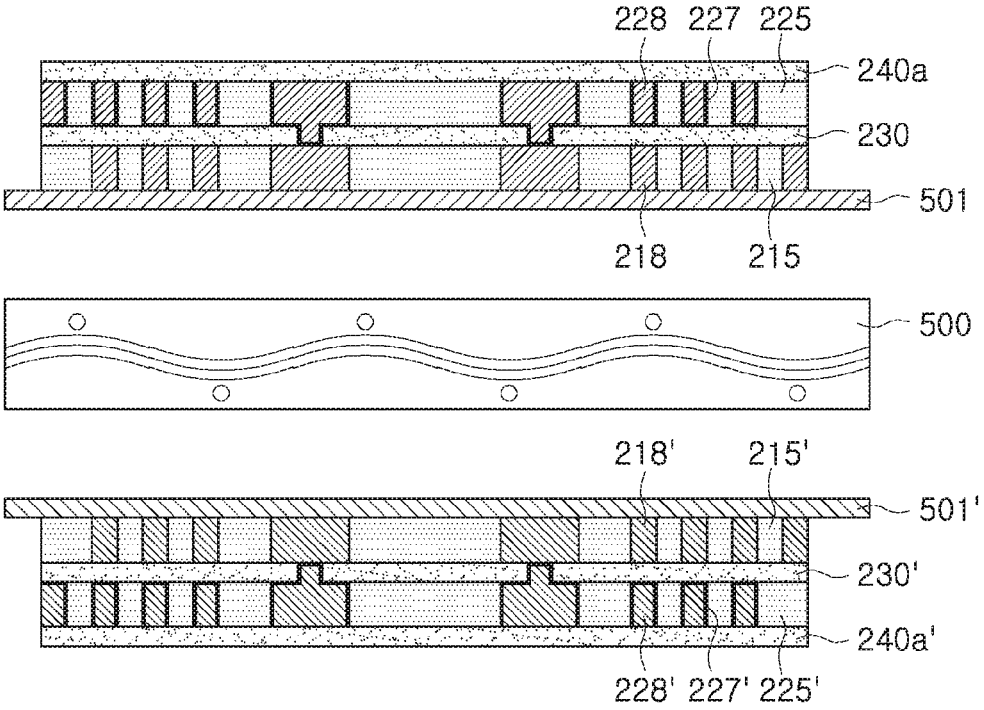
Figure 11L:
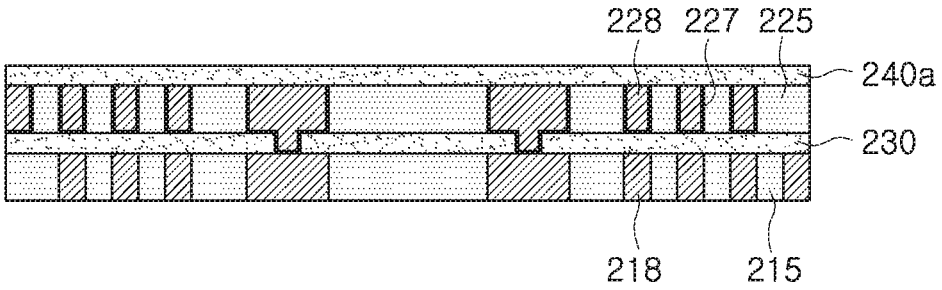
Figure 11M:
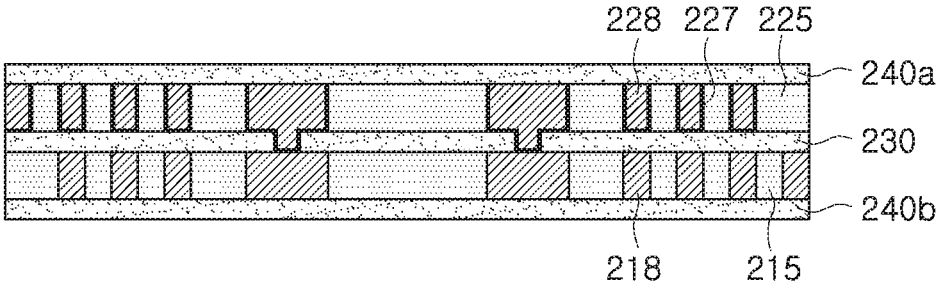
Figure 11N:
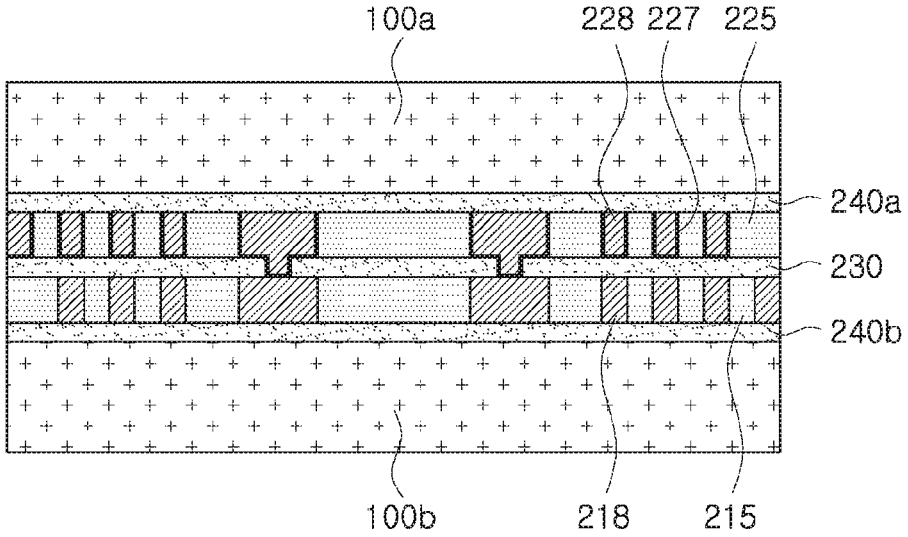
Figure 11O:
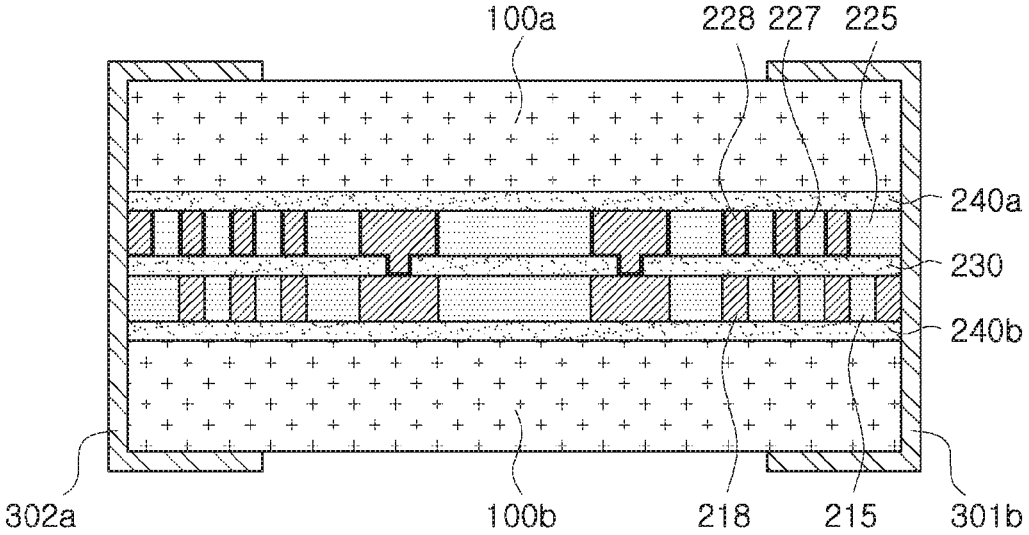

FIGS. 11A through 11O are views schematically illustrating processes of manufacturing a coil component according to an exemplary embodiment. Descriptions of contents overlapping the contents described above in a description for a method of manufacturing a coil component will be omitted, and contents different from the contents described above will be mainly described.

Referring to FIG. 11A, a board 500 having metal layers 501 and 501' disposed on at least one surface thereof may be prepared. For example, the board 500 having the metal layers 501 and 501' disposed on at least one surface thereof may be a copper clad laminate (CCL) generally used in a printed circuit board (PCB) field. Bonded surfaces between the board 500 and the metal layers 501 and 501' may be surface-treated or release layers may be provided between the board 500 and the metal layers 501 and 501', thereby facilitating separation of the board 500 in the following process. A material of the board 500 may be a resin in which a reinforcing material such as a glass fiber or an inorganic filler is impregnated, for example, prepreg, a thermosetting resin, a photo-curable resin, an Ajinomoto build-up film (ABF), or the like, but is not limited thereto. The metal layers 501 and 501' may contain one or more selected from the group consisting of gold, silver, platinum, copper, nickel, palladium, and alloys thereof, but are not limited thereto.

Referring to FIG. 11B, first insulating layers 215 and 215' may be formed on the metal layers 501 and 501' of the board 500. The first insulating layers 215 and 215' may be formed by a known method. For example, the first insulating layers 215 and 215' may be formed by compressing an insulating resin in a non-hardened film form using a laminator and then hardening the insulating resin. Alternatively, the first insulating layers 215 and 215' may be formed by applying an insulating material by a known method such as a spin coating method and then hardening the insulating material.

Referring to FIG. 11C, first opening patterns 216 and 216' may be formed in the first insulating layers 215 and 215'. The first opening patterns 216 and 216' may be formed by a known photolithography method. For example, the first opening patterns 216 and 216' may be patterned by exposing the first insulating layers in a desired pattern shape using the known photo mask and then developing the first insulating layers.

Referring to FIG. 11D, first conductive layers 218 and 218' may be formed in the first opening patterns 216 and 216'. A method of forming the first conductive layers 218 and 218' is not particularly limited. That is, the first conductive layers 218 and 218' may be formed by applying a method well known in the related art, for example, an electroless plating method, an electroplating method, or the like, using the metal layers 501 and 501' as seeds and using resist films such as dry films, or the like.

Referring to FIG. 11E, interlayer dielectric layers 230 and 230' may be formed on the first insulating layers 215 and 215'. The interlayer dielectric layers 230 and 230' may be formed by a known method. For example, the interlayer dielectric layers 230 and 230' may be formed by compressing an Ajinomoto build-up film (ABF), or the like, using a laminator and then hardening the ABF. Then, through-holes 236 and 236' may be formed in the interlayer dielectric layers 230 and 230' in order to form via patterns 232*a* and 232*b*. The through-holes 236 and 236' may be formed by mechanical drilling and/or laser drilling, a sand blasting method using particles for polishing, a dry etching method using plasma, or the like. In addition, when the interlayer dielectric layers 230 and 230' contain a photosensitive resin, the through-holes 230 and 230' may also be formed by a photolithography method. In a case in which the through-holes 236 and 236' are formed using the mechanical drilling and/or the laser drilling, resin smears in the through-holes 236 and 236' may be removed by performing desmearing using a method such as a permanganate method, or the like.

Referring to FIG. 11F, second insulating layers 225 and 225' may be formed on the interlayer dielectric layers 230 and 230'. The second insulating layers 225 and 225' may also be formed by a known method. For example, the second insulating layers 225 and 225' may be formed by compressing an insulating resin in a non-hardened film form using a laminator and then hardening the insulating resin. Alternatively, the second insulating layers 225 and 225' may be formed by applying an insulating material by the known method such as a spin method and then hardening the insulating material. Then, second opening patterns 226 and 226' may be formed in the second insulating layers 225 and 225'. The second opening patterns 226 and 226' may be formed by a known photolithography method. For example, the second opening patterns 226 and 226' may be patterned by exposing the second insulating layers in a desired pattern shape using the known photo mask and then developing the second insulating layers.

Cross sections of the second opening patterns 226 and 226' may be controlled to have a desired shape by adjusting a type of photosensitive resin of the second insulating layers 225 and 225', exposure strength of the second insulating layers 225 and 225', an exposure time of the second insulating layers 225 and 225', a concentration of a developer, a development time, or the like. For example, when the second insulating layers 225 and 225' are a positive type, the cross sections of the second opening patterns 226 and 226' may be controlled to have end portions having a rounded shape by allowing strong ultraviolet (UV) rays to be irradiated to the vicinity of upper surfaces of the second insulating layers 225 and 225' and allowing weak ultraviolet (UV) rays to be irradiated to the vicinity of lower surfaces of the second insulating layers 225 and 225'. Here, when the development time is controlled, the cross sections of the second opening patterns 226 and 226' may be controlled to have end portions having various rounded shapes as illustrated in FIGS. 5 through 10 due to isotropic properties of the second insulating layers in a dissolving process. In addition, when the second insulating layers 225 and 225' are negative type layers, the cross sections of the second opening patterns 226 and 226' may be controlled to have end portions having a reverse tapered shape by allowing strong ultraviolet (UV) rays to be irradiated to the vicinity of upper surfaces of the second insulating layers 225 and 225' and allowing weak ultraviolet (UV) rays to be irradiated to the vicinity of lower surfaces of the second insulating layers 225 and 225'. Here, when the exposure strength and the development time are increased while heat-treating the lower surfaces, the cross sections of the second opening patterns 226 and 226' may be implemented to have the rounded shape even through the second insulating layers 225 and 225' are the negative type. This content may be similarly applied to the first insulating layers 215 and 215' described above.

Referring to FIG. 11G, seed layers 227 and 227' may be formed on upper surfaces of the second insulating layers 225 and 225' and inner side surfaces and lower surfaces of the second opening patterns 226 and 226'. As described above, the seed layers 227 and 227' may have the multilayer structure. In this case, the buffer seed layer may first be formed, and the plating seed layer may be formed on the buffer seed layer. A method of forming the seed layers 227 and 227' is not particularly limited, but may be a method well known in the related art, for example, any method that may form the seed layers in a thin film form, such as a sputtering method, a spin coating method, a chemical copper plating method, or the like.

Referring to FIG. 11H, second conductive layers 228 and 228' may be formed on the seed layers 227 and 227'. A method of forming the second conductive layers 228 and 228' is not particularly limited. That is, the second conductive layers 228 and 228' may be formed through entire surface plating by applying a method well known in the related art, for example, an electroless plating method, an electroplating method, or the like, on the basis of the seed layers 227 and 227'.

Referring to FIG. 11I, the upper surfaces of the second insulating layers 225 and 225' on which the second conductive layers 228 and 228' are formed may be planarized. Upper surfaces of the second conductive layers 228 and 228' may be substantially coplanar with the upper surfaces of the second insulating layers 225 and 225' through the planarization. In addition, the upper surfaces of the second conductive layers 228 and 228' may be substantially coplanar with open surfaces of the seed layers 227 and 227'. The seed layers 227 and 227' may remain only in the second opening patterns 226 and 226'. A method of planarizing the upper surfaces of the second insulating layers 225 and 225' is not particularly limited, but may be a method well known in the related art, for example, a chemical mechanical polishing (CMP) method, a lapping method, a grinding method, or the like.

Although a case in which only two coil layers 210 and 220 and one interlayer dielectric layer 230 are formed has been illustrated for convenience in the drawings, more layers may be formed depending on a desired capacity. Here, additionally formed coil layers may be formed by the same method as the method of forming the second coil layer 220.

Referring to FIG. 11J, first insulating cover layers 240*a* and 240*a'* may be formed on the second insulating layers 225 and 225'. The first insulating cover layers 240*a* and 240*a'* may be formed by a known method. For example, the first insulating cover layers 240*a* and 240*a'* may be formed by compressing an Ajinomoto build-up film (ABF), or the like, using a laminator and then hardening the ABF.

Referring to FIG. 11K, the metal layers 501 and 501' may be separated from the board 500. Here, the metal layers 501 and 501' may be separated from the board 500 using a blade, but are not limited thereto. That is, all methods known in the art may be used to separate the metal layers 501 and 501' from the board 500. It may be appreciated that in a case in which the coil components are manufactured through the series of processes described above, productivity may be doubled by one process. Hereinafter, only an upper coil component after the separation will be described.

Referring to 11L, the metal layer 501 may be removed from the first insulating layer 215. The metal layer 501 may be removed by an etching method, or the like, well known in the related art. Here, the lower surface of the first conductive layer 218 may be affected in the etching process, such that the steps $H_1$ described above may be generated.

Referring to FIG. 11M, the second insulating cover layer 240*b* may be formed below the first insulating layer 215. The second insulating cover layer 240*b* may also be formed by the known method. For example, the second insulating cover layer 240*b* may be formed by compressing an Ajinomoto build-up film (ABF), or the like, using a laminator and then hardening the ABF.

Referring to FIG. 11N, the first cover part 100*a* and the second cover part 100*b* may be formed on the first insulating cover layer 240*a* and below the second insulating cover layer 240*b*, respectively. The first and second cover part 100*a* and 100*b* may be formed by, for example, compressing and stacking first and second sheet type magnetic materials on the first insulating cover layer 240*a* and below the second insulating cover layer 240*b*, respectively.

Referring to FIG. 11O, the external electrodes 301*a*, 301*b*, 302*a*, and 302*b* of which at least portions are disposed on the first cover part 100*a* and the second cover part 100*b* may be formed. A method of forming the external electrodes 301*a*, 301*b*, 302*a*, and 302*b* is not particularly limited, but may be a known method such as a printing method, a dipping method, or the like.

Although a case in which only coil component 10 is manufactured has been illustrated for convenience in the drawings, the coil component may be manufactured by simultaneously forming a plurality of coil components on one large board and then individually cutting the plurality of coil components, in a real mass production process.

As set forth above, according to an exemplary embodiment in the present disclosure, a coil component in which productivity is excellent, a low resistance may be secured due to a decrease in a coil loss rate, and resolution of a fine line width may be improved, and a method of manufacturing the same has been provided.

While exemplary embodiments have been shown and described above, it will be apparent to those skilled in the art that modifications and variations could be made without departing from the scope of the present invention as defined by the appended claims.

What is claimed is:

1. A coil component comprising:

a coil part including a first coil layer and a second coil layer disposed above the first coil layer, wherein the first coil layer includes a first insulating layer having a first opening pattern and a first conductive layer disposed in the first opening pattern, the second coil layer includes a second insulating layer having a second opening pattern, a seed layer covering inner side surfaces and a lower surface of the second opening pattern, and a second conductive layer disposed on the seed layer in the second opening pattern, the first and second insulating layers are disposed between adjacent turns of the first and second conductive layers, respectively, the first insulating layer is not disposed directly below the first coil layer, and a lower surface of the first insulating layer is disposed at a different level from a lower surface of the first conductive layer and the first coil layer does not include a seed layer.

2. The coil component of claim 1, wherein the lower surface of the first conductive layer and the lower surface of the first insulating layer have a step therebetween.

3. The coil component of claim 2, wherein a step region in the first opening pattern is filled with an insulating material.

4. The coil component of claim 1, wherein a cross-sectional shape of the second opening pattern is a rounded shape.

5. The coil component of claim 4, wherein the rounded shape is a shape in which a central portion of an end portion thereof protrudes toward a lower surface of the second insulating layer.

6. The coil component of claim 4, wherein an end portion of the rounded shape is spaced apart from a lower surface of the second insulating layer by a predetennined interval.

7. The coil component of claim 1, wherein an upper surface of the second conductive layer is coplanar with an upper surface of the second insulating layer.

8. The coil component of claim 7, wherein the upper surface of the second conductive layer is coplanar with an open surface of the seed layer.

9. The coil component of claim 1, wherein cross-sectional shapes of the first and second opening patterns are reversed taper shapes.

10. The coil component of claim 1, wherein planar shapes of the first and second opening patterns are spiral shapes.

11. The coil component of claim 1, wherein the coil part further includes:

an interlayer dielectric layer disposed between the first and second coil layers;

a first insulating cover layer disposed on the second coil layer; and a second insulating cover layer disposed below the first coil layer.

12. The coil component of claim 1, further comprising:

a first cover part disposed on the coil part and containing a magnetic material; and a second cover part disposed below the coil part and containing a magnetic material.

13. The coil component of claim 12, wherein the first and second cover parts are sheet type cover parts.

14. The coil component of claim 12, further comprising external electrodes of which at least portions are disposed on the first cover part and at least other portions are disposed on the second cover part.

15. The coil component of claim 1, further comprising a magnetic core penetrating through a central portion of the coil part.

16. The coil component of claim 1, further comprising a magnetic core penetrating through a central portion of the coil part, wherein the magnetic core is integrated with the first and second cover parts.

* * * * *